US006817969B2

(12) United States Patent
Hermodsson et al.

(10) Patent No.: US 6,817,969 B2
(45) Date of Patent: Nov. 16, 2004

(54) CARTON PULLER VACUUM HEAD AND METHOD

(75) Inventors: Goran Hermodsson, Staffanstorp (SE); Masayuki Taniguchi, Tokyo (JP); Yoshiki Katsumata, Buffalo Grove, IL (US); Dave McDonough, Dundee, IL (US); Ronnie Jakobsson, Blaine, MN (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 10/356,141

(22) Filed: Jan. 31, 2003

(65) Prior Publication Data

US 2004/0148911 A1 Aug. 5, 2004

(51) Int. Cl.[7] ..... B31B 1/28
(52) U.S. Cl. ..... 493/163; 493/175; 493/184
(58) Field of Search ..... 493/163, 164, 493/165, 175, 176, 184, 123; 53/565, 563, 575

(56) References Cited

U.S. PATENT DOCUMENTS

| | | | | |
|---|---|---|---|---|
| 3,486,423 A | | 12/1969 | Mistarz | |
| 3,709,349 A | | 1/1973 | Buhayar et al. | |
| 3,939,960 A | | 2/1976 | Farfaglia | |
| 4,588,391 A | | 5/1986 | Evans et al. | |
| 4,718,882 A | * | 1/1988 | Bressler et al. | 493/164 |
| 5,133,169 A | * | 7/1992 | Tesch et al. | 53/247 |
| 5,176,608 A | * | 1/1993 | Wakabayashi et al. | 493/125 |
| 5,191,964 A | | 3/1993 | Spisak et al. | |
| 5,690,979 A | * | 11/1997 | Bourns et al. | 426/307 |
| 5,694,746 A | * | 12/1997 | Chung et al. | 53/456 |
| 5,867,966 A | * | 2/1999 | Mogard | 53/133.2 |
| 5,921,375 A | | 7/1999 | van Laar | |
| 6,094,884 A | | 8/2000 | Christensen et al. | |
| 6,385,950 B1 | | 5/2002 | Anderson | |

* cited by examiner

*Primary Examiner*—Eugene L Kim
(74) *Attorney, Agent, or Firm*—Welsh & Katz, Ltd.

(57) ABSTRACT

A carton pulling assembly pulls a partially formed carton from a mandrel on a form, fill and seal packaging machine. The machine has a vacuum source for providing a vacuum and includes a machine controller. The partially formed carton has a sealed bottom wall. The carton pulling assembly includes a carton puller element movable in a reciprocating manner toward and away from the mandrel. A vacuum head assembly is mounted to the carton puller element for reciprocating movement therewith. The vacuum head assembly includes a cylinder and a finger configured for reciprocating movement within the cylinder having a suction element mounted thereto. The finger has a vacuum channel for communicating vacuum from the cylinder to the suction element. The finger is movable between an extended position in which the suction element contacts and engages the partially formed carton sealed bottom wall and a retracted position in which the reciprocating finger pulls the carton from the mandrel. The reciprocating finger moves toward the extended position by application of the vacuum to the vacuum head assembly while communicating vacuum to the suction element. A method for pulling a partially formed carton from a mandrel is also disclosed.

18 Claims, 3 Drawing Sheets

CARTON PULLER VACUUM HEAD AND METHOD

BACKGROUND OF THE INVENTION

The present invention is directed to a device and method for removing a carton from a mandrel in a packaging machine. More particularly, the present invention is directed to a vacuum-assisted device and method for removing a partially erected carton from a mandrel in a form, fill and seal packaging machine, that minimizes the opportunity for inadvertent contamination of the machine.

Form, fill and seal packaging machine are well known in the art. These machines are widely used in the food packaging industry for forming a package, filling the package with a liquid or solid food (or a mixture of liquid and solid foods), and sealing the package after filling.

In such machines, sterilization, generally, must be kept at a maximum. That is, all of the carton contacting surfaces must be maintained at a high level of cleanliness in order to reduce the opportunity for product contamination. A number of processes and philosophies are carried out in such machines in order to maintain the requisite high levels of cleanliness. One such philosophy is to minimize contact with food-contacting surfaces. That is, minimal if any contact should be made with any machine surfaces that come into contact with a food-contacting surface (such as the interior of a package, e.g., carton).

One primary example of this is in connection with carton mandrels. The mandrel is that part of the machine on which the carton is carried as the bottom panels are folded and sealed, to form the carton bottom. In a typical operation, a carton is taken from a flat, folded form and opened to an open ended tubular form. The tubular form is then inserted onto or over the mandrel. The mandrel has a rectangular overall shape and a cap that is a substantially flat, solid surface. The cap corresponds to the carton bottom location. The bottom panels are then heated, folded and "pressed" to form the sealed bottom wall. As such, the mandrel, and in particular the mandrel cap is in contact with the carton food-contacting surfaces.

Typically, the mandrel is mounted to a rotating turret. In such an arrangement, the turret rotates to the various positions for inserting a tubular blank onto the mandrel, heating and folding the bottom flaps, and sealing the flaps to form the sealed bottom. Subsequent to forming the sealed bottom wall, the partially erected carton (that is, the carton with the bottom wall formed and the top open for filling), is removed from the turret. Some known machines also include a pre-folding station, prior to heating, to pre-fold the bottom flaps.

In a typical arrangement, the carton is positioned on a conveying system for moving the carton through various stations for sterilizing, filling and top sealing. Generally, the sterilizing, filling and top sealing stations lie along a linear path and the carton is removed from the mandrel and positioned on a linear conveyor, such as a chain or sleeve and chain conveyor system. One exemplary conveyor system is that disclosed in Massey, U.S. Pat. No. 5,826,406, commonly assigned with the present application and incorporated herein by reference.

To remove the carton from the mandrel for transfer onto the conveyor, known systems use a stationary suction cup vacuum arrangement that is positioned on a moving arm. That is, the arm moves up to contact the bottom of the carton and pulls the carton from mandrel to position the carton on the conveyor.

The suction cup itself is, however, stationary relative to the moving arm. In such an arrangement, the suction cup, when the arm is in the raised position is located only a small distance from the mandrel cap when the mandrel is at the bottom station (the station at which the cartons are pulled). Generally, the gap between the mandrel cap and the suction cup is equal to the thickness of the folded and sealed bottom wall of the carton. That is, the gap is quite small. This is particularly true when non-flat carton bottom profiles are used. This assures that the carton will be grasped by the suction cup and removed from the mandrel.

While these systems function well to "pull" the carton from the mandrel, one drawback to this arrangement is that the suction cups, because they are formed from a soft material tend to deform over time. As such, the suction cup can be so deformed as to contact the mandrel cap when there is no carton on the mandrel. This is highly undesirable in that the mandrel cap can become contaminated by contact with the suction cup.

Accordingly, there exists a need for an improved suction cup-type, vacuum assisted device and method for pulling cartons from a mandrel on a form, fill and seal packaging machine. Desirably, such a device is readily usable on existing packaging machine. Most desirably such a device and method prevent inadvertent contact of the suction cup when a carton is not present on the mandrel, during machine operation.

BRIEF SUMMARY OF THE INVENTION

A form, fill and seal packaging machine includes a carton pulling assembly for pulling a partially formed carton from a mandrel on the machine. The cartons are partially formed (that is, the bottom wall is formed) while carried on the mandrel. A plurality of such mandrels are carried on a rotating turret.

The carton pulling assembly includes a carton puller element movable in a reciprocating manner toward and away from the mandrel. A vacuum head assembly is mounted to the carton puller element for reciprocating movement therewith. The vacuum head assembly includes a cylinder and a finger configured for reciprocating movement within the cylinder.

A suction element is mounted to the reciprocating finger. The finger has a vacuum channel for communicating vacuum from the cylinder to the suction element. The reciprocating finger is movable between an extended position in which the suction element contacts and engages the carton sealed bottom wall and a retracted position in which the reciprocating finger pulls the carton from the mandrel. The reciprocating finger is movable toward the extended position by application of vacuum to the vacuum head assembly while communicating vacuum to the suction element.

In a present embodiment, the cylinder defines an upper region and a lower region separated from one another by a base portion of the reciprocating finger. The base portion extends outwardly to contact an inner wall of the cylinder to form a seal. The cylinder includes one or more vacuum channels extending upwardly, within the wall. The channels terminate at a port at the cylinder upper region for communicating vacuum to the cylinder upper region, to move (e.g., "pull") the finger to the extended position for contacting and engaging the carton bottom wall.

In a preferred embodiment, a base plate is mounted to the base of the cylinder. The base plate has a transverse channel formed therein that is configured to distribute the vacuum to the cylinder vacuum channels. A vent extends between the finger vacuum channel and the cylinder upper region.

The suction element is seated and supported in a holder and a fastener extends centrally through the suction element to secure the suction element to the finger. The fastener is formed having a centrally disposed longitudinal bore for communicating vacuum from the finger vacuum channel to the suction element.

The vacuum head assembly is configured such that the finger, following engagement of the suction element with the carton, moves to the retracted position by application of vacuum to the cylinder lower region, through the vent.

A method for pulling a partially formed carton from the mandrel includes providing a carton puller element movable in a reciprocating manner toward and away from the mandrel. The carton puller element has a vacuum head assembly mounted thereto that includes a reciprocating finger having a suction element at an end thereof. A vacuum is communicated to the vacuum head assembly and to the suction element.

The finger is extended from the vacuum head assembly toward and into engagement with the carton bottom wall. The finger is retracted (i.e., moved away) from the mandrel and pulls the carton from the mandrel. The carton puller element is moved away from the mandrel and the carton is positioned on a conveyor of the machine. The carton is then released from the suction element.

In a present embodiment, the vacuum is selectively communicated to the vacuum head assembly, preferably when a carton is present on the mandrel.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
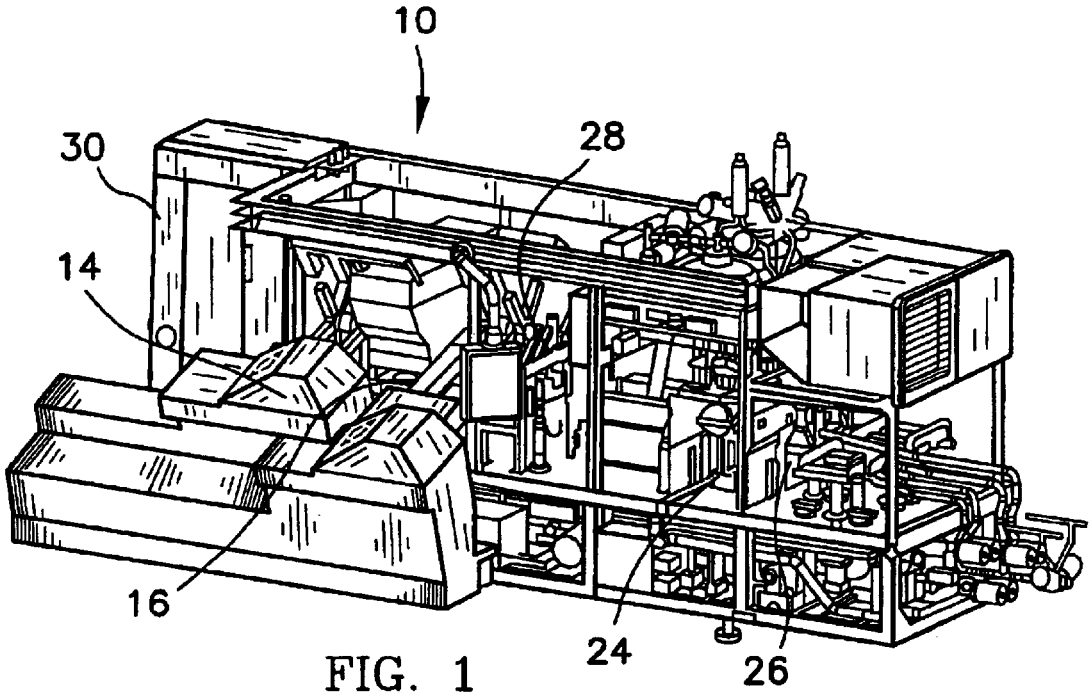
FIG. 1 illustrates an exemplary form, fill and seal packaging machine having an improved carton pulling device the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 2:
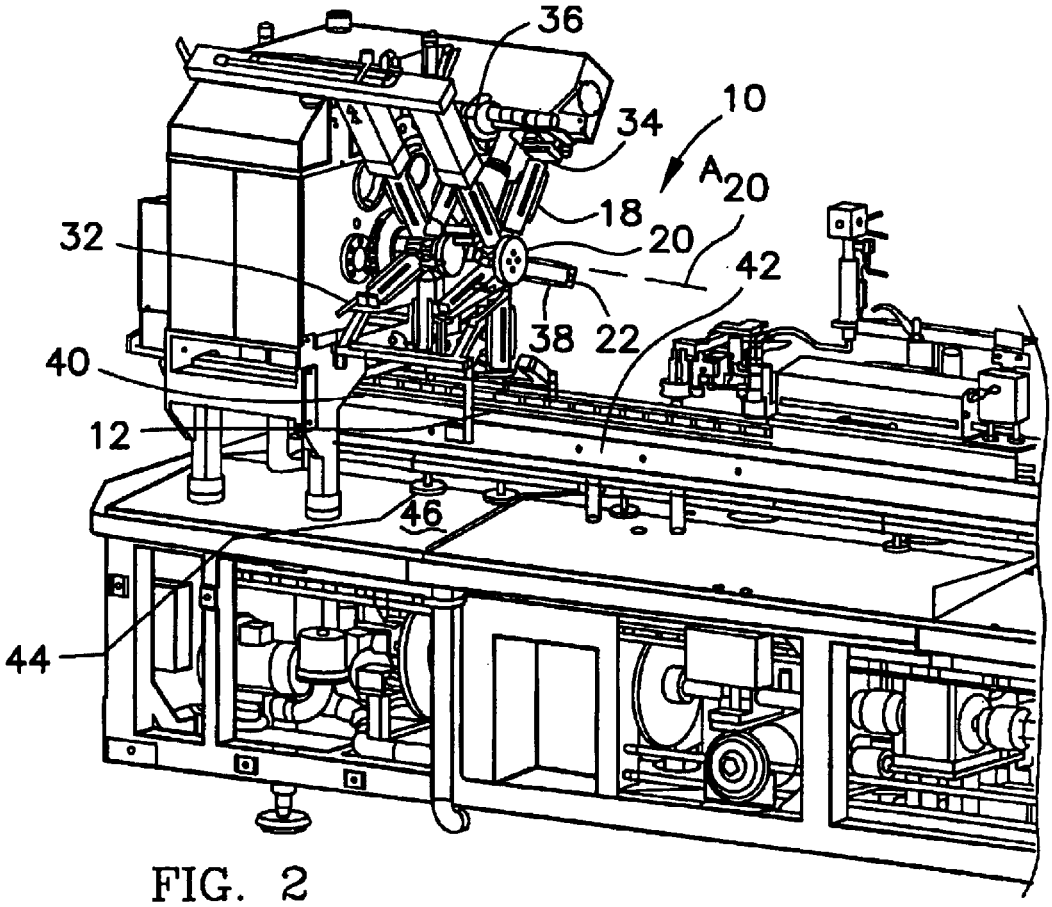
FIG. 2 is partial perspective view of the form, fill and seal packaging machine of FIG. 1, showing the front end and general layout of the machine, and illustrating the location of the carton pulling assembly.

Referring now to the figures and in particular to FIGS. 1 and 2, there is shown a form, fill and seal packaging machine 10 that incorporates an improved carton pulling system 12. The form, fill and seal packaging machine 10 can be such as that disclosed in Katsumata, U.S. Pat. No. 6,012,267, which patent is assigned to the assignee of the present invention and is incorporated by reference herein. The machine 10 is configured to store a series of carton blanks in a flat, folded form, erect the blanks into a tubular form, fold and seal the bottom flaps of the carton, fill and seal the cartons as they move through the machine 10.

A typical filling machine 10 includes a carton magazine 14 for storing the flat, folded carton blanks. The filling machine 10 includes a carton erection station 16 that receives the cartons in the flat, folded form, and opens or erects the cartons into the tubular form. The tubular formed cartons (which at this point in the process have open tops and bottoms) are then fed onto a mandrel 18. A series of such mandrels 18 is positioned about a turret 20 on the machine 10. Each mandrel 18 has a mandrel cap 22 at an end of the mandrel 18. The mandrel cap 22 is a generally flat surface that serves as an anvil, as will be described below. The carton is positioned on the mandrel 18 such that the bottom of the carton is at the free end, i.e., at about the cap 22, of the mandrel 18.

The remaining stations include a filling station 24 at which product is filled into the carton, and a top sealing station 26 for sealing the top of the carton after filling. Other stations can include one or more sterilizations stations 28 and a fitment or closure station (not shown) for positioning and securing a closure package (such as a spout and cap combination) to the carton. The overall operation of the machine 10 is controlled by a controller 30.

Referring again to FIG. 2, the turret 20 rotates to move the mandrels 18 through various positions. At a first position, indicated generally at 32, the tubular carton is inserted onto the mandrel 18. The mandrel 18 is then rotated through positions at which the bottom flaps are folded, heated and subject to compression as by a pressure plate 34 that is urged against the bottom flaps which are positioned between the mandrel cap 22 and the pressure plate 34. An exemplary bottom sealing arrangement is illustrated in Christensen et al., U.S. Pat. No. 6,094,884, which patent is assigned to the assignee of the present invention and is incorporated by reference herein.

To soften the carton material (that is, the plastic or polymeric out coating of the carton), a heater 36, which moves into the open carton bottom end, uses a stream of heated air to raise the temperature of the coating material to a predetermined temperature. This softens the coatings so that the coatings on the compressed flaps fuse into one another to form a liquid tight bottom wall.

The partially erected carton, which at this point is still on the mandrel (as indicated generally at 38) and has the bottom flaps folded and sealed to form a sealed carton bottom, is then indexed (on the turret 20) to a carton pulling station 40.

At this station 40, the carton is "pulled" from the mandrel 18 and positioned on a conveyor 42, such as the exemplary linear conveyor, for conveyance through the various sterilization 28, filling 24 and sealing 26 stations as described above.

As will be appreciated by those skilled in the art, in order to remove the carton from the mandrel 18, the carton must be pulled away from (in the present device downward), a distance at least equal to the height of the carton so that the carton will clear the end of the mandrel 18 (at the mandrel cap 22). This is necessary because the turret 20, which is a relatively large component of the machine 10 rotates about an axis $A_{20}$, which axis $A_{20}$ remains stationary. That is, the turret 20 does not move up-and-down, and as such, the carton must be pulled completely clear of the mandrel 18.

Figure 3:
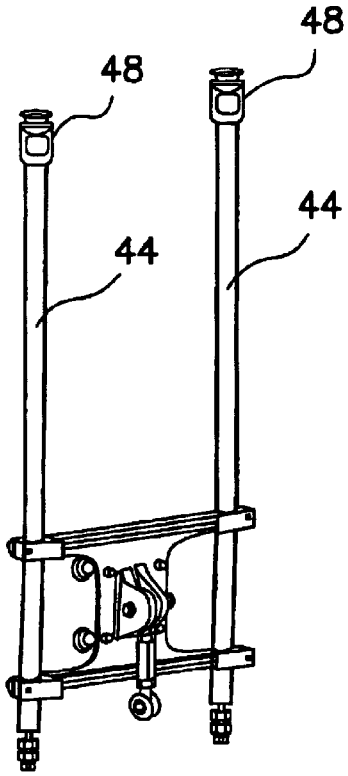
FIG. 3 is a perspective illustration of an exemplary carton pulling assembly, showing a carton pulling vacuum head mounted to the end of each of two carton puller rods.
Figure 4:
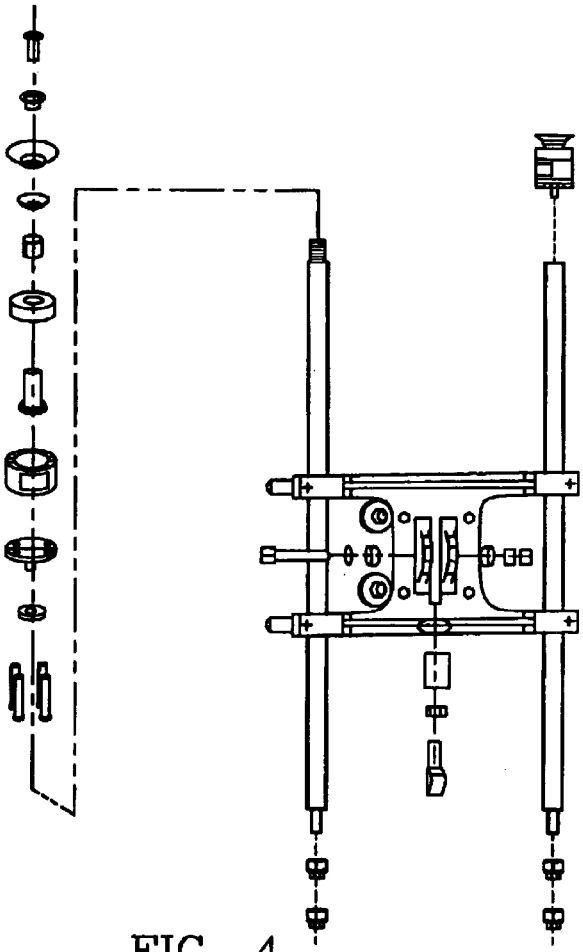
FIG. 4 is an illustration similar to FIG. 3, but showing the vacuum puller head in a partially exploded.
Figure 5:
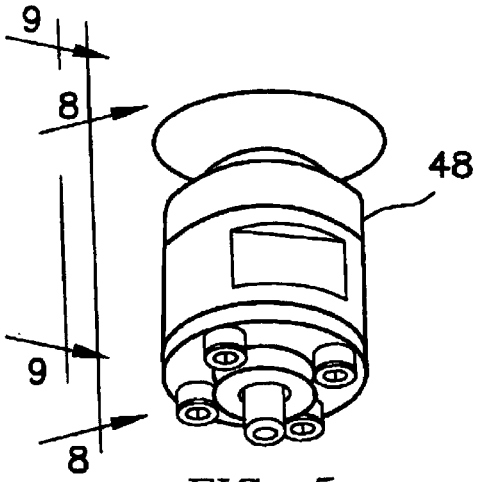
FIG. 5 is a perspective view of the vacuum puller head.

Referring now to FIG. 3, at the pulling station 40, a reciprocating element or carton puller rod 44 extends upward, through the table-top 46 of the machine 10 (see briefly FIG. 2) and moves toward and away from the mandrel 18. As will be understood from the drawings, as the element 44 moves toward the mandrel 18, it moves away from the conveyor 42. Conversely, when the puller rod 44 moves away from the mandrel 18, it moves toward the conveyor 42. In known pulling stations, as described above, the rod has a vacuum channel that traverses through the center of the rod and a suction cup mounted to an end thereof. The vacuum channel is in communication with the suction cup to draw a vacuum at the cup to secure the carton to the rod.

When the suction cup contacts the carton bottom, the carton bottom is suctioned to the rod and the rod, which moves down, pulls the carton from the mandrel. The terminal position of the puller rod positions the carton on the conveyor portion of the machine. Regardless of whether a carton is positioned on the mandrel, the puller rod moves toward and away from the mandrel. Thus, one identified problem with known puller systems is that in the event that the suction cup is deformed, there exists the potential for the suction cup to contact the mandrel cap when there is no carton on the mandrel, and as such, possibly contaminate the mandrel.

The present carton pulling system 12 includes the carton puller rod 44, which is a reciprocating rod, and includes a carton puller vacuum head assembly 48 mounted at the end of the rod 44. The rod 44 has a section of tubing 47 that has a bore 49 longitudinally disposed therein. The vacuum head assembly 48 includes a piston-like extension finger 50 to which a suction cup 52 is attached. The finger 50 has a through bore 51 formed longitudinally therein that defines a vacuum channel. The assembly 48 includes a cylinder housing 54 in which the reciprocating extension finger 50 is mounted. A base plate 56 is secured to the bottom of the cylinder housing 54 by a plurality of fasteners 58, such as machine screws. An end cap 60 is fastened to the top of the cylinder housing 54.

A bushing 62 and suction cup holder 64 are positioned at an upper end of the extension finger 50. The bushing 62 is positioned within a bore 66 in the end cap 60, about the finger 50, to maintain alignment of the finger 50 as it reciprocates within the assembly 48. The suction cup holder 64 provides support for the suction cup 52. The suction cup 52 is supported by the holder 64 and is secured to the finger 50 through the holder 64 by an inner bushing 68 and a fastener 70, such as a machine screw. The fastener 70 has a bore 72 that defines a vacuum channel or port formed in the center thereof. The port 72 provides a communication path for vacuum from a vacuum source through the rod 44 and finger 50, and to the suction cup 52.

Figure 7:
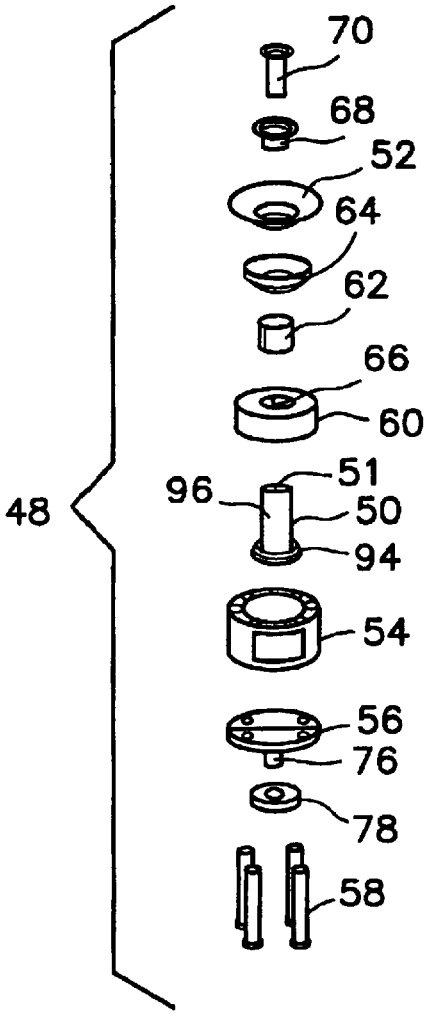
FIG. 7 is a an enlarged exploded view of the vacuum puller head.
Figure 8:
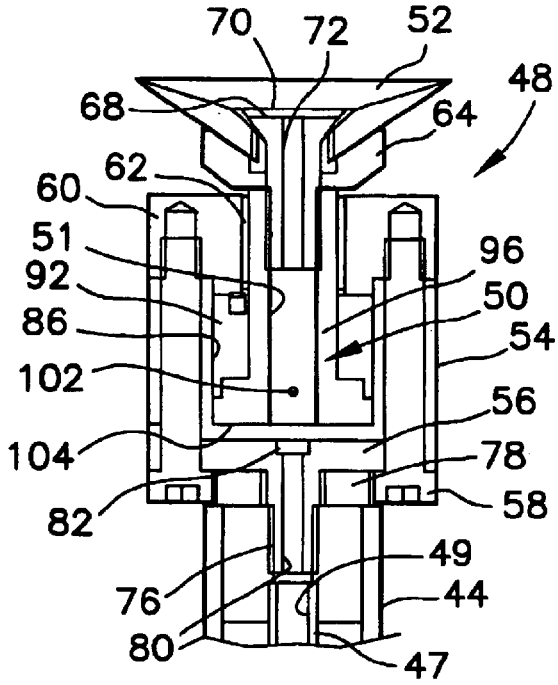
FIG. 8 is a partial cross-sectional view of the vacuum puller head taken along line 8—8 of FIG. 5.
Figure 9:
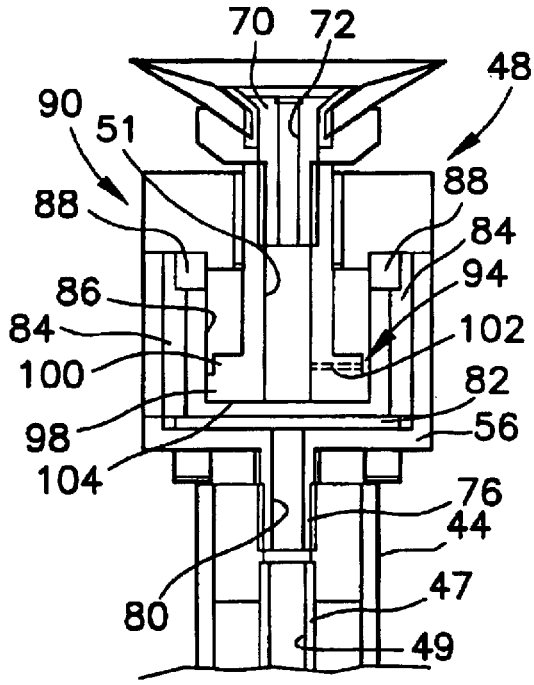
FIG. 9 is a partial cross-sectional view of the vacuum puller head taken along line 9—9 of FIG. 5.

As best seen in FIGS. 7–9, the base plate 56 is mounted to the puller rod 44 at a base plate stub 76. A spacer 78 is positioned around the stub 76 at the base plate 56. The stub 76 has a bore 80 therein that opens to a transverse vacuum channel 82 in the plate 56. Channels 84 are formed in the cylindrical side wall 86 of the cylinder 54 that open into ports 88 at an upper end 90 of the cylinder 54. As such, vacuum communication is provided from the vacuum source, through the rod 44, into the stub 76 and base plate transverse channel 82. From the transverse channel 82, vacuum is communicated through the cylinder channels 84 into an upper cylinder region 92, above the extension finger 50. Vacuum is also communicated through a vent 102 in the finger 50, through the central bore 51, up to the suction element 52 through the fastener bore 72.

Figure 6A:
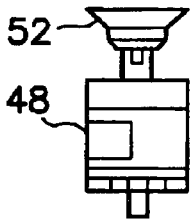
FIGS. 6A and 6B are schematic illustrations of the carton puller vacuum head assembly in the extended position (FIG. 6A) and the retracted position (FIG. 6B)
Figure 6B:
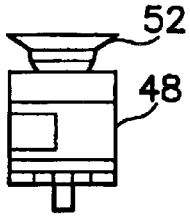

As set forth above, the extension finger 50 is formed as a piston, having a through-bore 51 that defines a vacuum channel. The finger 50 moves between an extended position (FIG. 6A) in which the suction cup 52 engages the carton bottom wall and a retracted position (FIG. 6B) in which the finger 50 pulls away from the carton bottom wall. The piston-like finger 50 has a two-step base portion 94 and an elongated stem 96. A lower portion 98 of the base 94 extends to the cylinder wall 86 to form a seal at the periphery of the lower portion 98. The base lower portion thus defines the upper cylinder region 92 and a lower cylinder region 104. An upper step portion 100 extends toward, but not to the cylinder wall 86. The vent opening 102 is formed in the upper step portion 100 to provide communication between the finger vacuum channel 51, through the outer wall, into the upper cylinder region 92.

In operation, a vacuum is drawn through the puller rod 44 into the head assembly base plate 56. The vacuum is transmitted through the stub 76 and into the transverse channel 82. The transverse channel 82 is open to the cylinder channels 84. The transverse channel 82 is, however, closed to, i.e., sealed from, the lower cylinder region 104. Thus, vacuum is drawn only from the upper cylinder region 92.

In that the cylinder channels 84 are open to the cylinder upper region 92, the vacuum (lowered pressure) in the upper cylinder region 92, "pulls" the finger 50 upward in the cylinder 54. Although vacuum is drawn through the vent 102, because this is a "small" balanced opening, (about 0.8 mm in diameter), it effects a restriction. Thus, the upper cylinder region is at a reduced pressure, drawing the finger 50 upward. This in turn moves the attached suction cup 52 upward to contact the carton bottom. As set forth above, the finger central (vacuum) channel 51 is open, as is the fastener channel 72. Thus, vacuum will be drawn at the suction cup 52, and contact of the suction cup 52 with the carton bottom wall will cause the suction cup 52 to adhere to the carton.

As seen in FIG. 9, the ports 88 into the upper cylinder region 92 (from the cylinder channels 84) are positioned such that when the finger 50 is at the top of its stroke, the ports 88 are partially closed off by the base lower wall 98. At this point, because the fastener channel 72 is closed off (due to contact with the carton), the vacuum is communicated toward and into the cylinder lower region 104 through the vent 102 and the finger channel 51. As such, the pressure is lower in the lower cylinder region 104. This then "pulls" the finger 50 (as a piston) downward. Because the carton is "adhered" to the suction cup 52, this will in turn begin to draw the carton from the mandrel 18. In addition, at this point in time, the puller rod 44 begins to move downward, also drawing the carton from the mandrel 18.

The vent opening 102 between the finger central channel 51 and the base upper step 100 serves a number of functions. First, as the carton finger 50 is "pulled" downward, immediately after contact with the carton, the vent 102 permits continued communication of vacuum with the suction cup 52 to further assure that the carton remains adhered to the suction cup 52, while also creating a lower pressure in the lower cylinder region 104 to "pull" the finger downward. In addition, when the puller rod 44 is at its low point, to permit releasing the carton, e.g., transferring the carton to the conveyor 42, the vacuum is isolated from the rod 44. The vent 102 facilitates venting any remaining vacuum from the region between the suction cup 52 and the carton bottom, to permit separating the cup 52 from the carton bottom wall. Thus, it will be appreciated that the size of the vent opening 102 must be balanced to assure that it is sufficiently restrictive so that the finger 50 is "pulled" up (upon vacuum), before the suction cup 52 contacts the carton, and so that it provides sufficient flow area for the finger 50 to be "pulled" down after the cup 52 contacts the carton.

As will be appreciated from a study of the figures and the present description, the vacuum head assembly 48 is configured such that when there is no vacuum present, the finger 50 remains in the retracted position. In this manner, even though the puller rod 44 extends toward the mandrel cap 22, because there is no vacuum at the head 48, the suction cup 52 will not be extended. This is important in that the machine 10 can be operated without cartons on the mandrels 18, and, so long as there is no vacuum, i.e., the controller 30 isolates vacuum to the puller rods 44, the suction cup 52 will not extend to contact the mandrel caps 22 and potentially contaminate the mandrels 18.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A carton pulling assembly for pulling a partially formed carton from a mandrel on a form, fill and seal packaging machine, the form, fill and seal packaging machine having a vacuum source for providing a vacuum, the packaging machine further having a machine controller, the partially formed carton having a sealed bottom wall formed from a plurality of panels, the carton pulling assembly comprising:

a carton puller element movable in a reciprocating manner toward and away from the mandrel;

a vacuum head assembly mounted to the carton puller element for reciprocating movement therewith, the vacuum head assembly including a cylinder and a finger configured for reciprocating movement within the cylinder, the vacuum head assembly including a suction element mounted to the reciprocating finger, the finger having a vacuum channel for communicating vacuum from the cylinder to the suction element, the reciprocating finger movable between an extended position in which the suction element contacts and engages the partially formed carton sealed bottom wall and a retracted position in which the reciprocating finger pulls the carton from the mandrel, the reciprocating finger movable toward the extended position by application of the vacuum to the vacuum head assembly while communicating vacuum to the auction element, wherein the cylinder defines an upper region and a lower region separated from one another by a base portion of the reciprocating finger, the base portion extending outwardly to contact an inner wall of the cylinder form a seal, wherein the vacuum, communicated to the upper cylinder region, moves the finger to the extended position for contacting and engaging the carton bottom wall.

2. The carton pulling assembly in accordance with claim 1 wherein the cylinder includes a vacuum channel extending upwardly, within the wall, and terminating at a port at the cylinder upper region, the vacuum being communicated to the cylinder upper region through the vacuum channel.

3. The carton pulling assembly in accordance with claim 2 including two vacuum channels formed within the cylinder wall.

4. The carton pulling assembly in accordance with claim 2 including a base plate having a transverse channel formed therein, the transverse channel configured to distribute vacuum to the cylinder vacuum channel.

5. The carton pulling assembly in accordance with claim 4 including a vent extending between the finger vacuum channel and the cylinder upper region wherein the vent provides communication of vacuum to the suction element.

6. The canon pulling assembly in accordance with claim 2 wherein the finger base portion, when in the extended position, partially overlies the cylinder vacuum port.

7. The carton pulling assembly in accordance with claim 1 wherein the suction element is seated and supported in a holder and including a fastener extending centrally through the suction element to secure the suction element to the finger.

8. The carton pulling assembly in accordance with claim 7 wherein the fastener includes a longitudinal bore for communicating vacuum from the finger vacuum channel to the suction clement.

9. The carton pulling assembly in accordance with claim 5 wherein the assembly is configured such that the finger, following engagement of the suction element with the carton, is moved to the retracted position by application of vacuum to the cylinder lower region through the vent.

10. A carton pulling assembly for pulling a partially formed carton from a mandrel on a form, fill and seal packaging machine, the form, fill and seal packaging machine having a vacuum source for providing a vacuum, the packaging machine further having a machine controller, the partially formed carton having a sealed bottom wall formed from a plurality of panels, the carton pulling assembly comprising:

a carton puller element movable in a reciprocating manner toward and away from the mandrel;

a vacuum head assembly mounted to the carton puller element for reciprocating movement therewith, the vacuum head assembly including a cylinder and a finger configured for reciprocating movement within the cylinder, the finger having a base portion extending outwardly to an inner wall of the cylinder forming a seal and defining an upper cylinder region and a lower cylinder region, the vacuum head assembly including a suction element mounted to the reciprocating finger, the finger having a vacuum channel for communicating vacuum from the cylinder to the suction element, the finger vacuum channel extending longitudinally through the finger and including a vent for communicating a vacuum from the upper cylinder region to the suction element, the cylinder having at least one cylinder vacuum channel formed in the wall extending from about a base of the cylinder and opening to a port at the cylinder upper region, the vacuum head assembly further including a base plate mounted to the base of the cylinder, the base plate having a transverse channel formed therein configured to distribute the vacuum to the cylinder vacuum channel, wherein the reciprocating finger is movable between an extended position in which the suction element contacts and engages the carton sealed bottom wall and a retracted position in which the reciprocating finger pulls the carton from the mandrel, the reciprocating finger movable toward the extended position by communicating vacuum to the cylinder upper region through the cylinder vacuum channel and wherein the finger base portion, when the finger is in the extended position, partially overlies the cylinder vacuum port.

11. The carton pulling assembly in accordance with claim 10 wherein the cylinder includes two vacuum channels and wherein the base plate transverse channel is elongated to provide vacuum communication with the vacuum channels.

12. The carton pulling assembly in accordance with claim 10 including a stub extending from the base plate, the stub having a central bore therein communicating with the transverse vacuum channel.

13. The carton pulling assembly in accordance with claim 10 wherein the suction element is seated and supported in a holder and including a fastener extending centrally through the suction element to secure the suction element to the finger, the fastener including a longitudinal bore for communicating vacuum from the finger vacuum channel to the suction element.

14. The carton pulling assembly in accordance with claim 10 wherein the assembly is configured such that the finger, following engagement of the suction element with the carton, is moved to the retracted position by application of vacuum to the cylinder lower region through the vent.

15. A method for pulling a partially formed carton from a mandrel on a form, fill and seal packaging machine, the form, fill and seal packaging machine having a vacuum source for providing a vacuum, the packaging machine further having a machine controller, the partially formed carton having a sealed bottom wall formed from a plurality of panels, the method comprising:

providing a carton puller element movable in a reciprocating manner toward and away from the mandrel, the carton puller element having a vacuum head assembly mounted thereto, the vacuum head assembly having a cylinder and a reciprocating finger having a suction element at an end thereof, the finger having a vacuum channel for communicating vacuum from the cylinder to the suction element, the reciprocating finger movable between an extended position in which the suction element contacts and engages the partially formed carton sealed bottom wall and a retracted position in which the reciprocating finger pulls the carton from the mandrel, the reciprocating finger movable toward the extended position by application of the vacuum to the vacuum head assembly while communicating vacuum to the suction element, the cylinder defining an upper region and a lower region separated from one another by a base portion of the reciprocating finger, the base portion extending outwardly to contact an inner wall of the cylinder to form a seal, wherein the vacuum, communicated to the upper cylinder region, moves the finger to the extended position for contacting and engaging the carton bottom wall;

communicating a vacuum to the vacuum head assembly and to the suction element;

extending the finger from the vacuum head assembly toward and into engagement with the carton bottom wall;

retracting the finger away from the mandrel and pulling the carton from the mandrel;

moving the carton puller element away from the mandrel; and releasing the carton from the suction element.

16. The method in accordance with claim 15 including the step of selectively communicating the vacuum to the vacuum head assembly.

17. The method in accordance with claim 16 including the step of selectively communicating the vacuum to the vacuum head assembly when a carton is present on the mandrel.

18. A method for pulling a partially formed carton from a mandrel on a form, fill and seal packaging machine, the form, fill and seal packaging machine having a vacuum source for providing a vacuum, the packaging machine further having a machine controller, the partially formed carton having a sealed bottom wall formed from a plurality of panels, the method comprising:

providing a carton puller element having first and second movable portions, the first and second movable portions each being movable in a reciprocating manner toward and away from the mandrel, the carton puller element second movable portion having a cylinder and a reciprocating finger having a suction element at an end thereof, the finger having a vacuum channel for communicating vacuum from the cylinder to the suction element, the reciprocating finger movable between an extended position in which the suction element contacts and engages the partially formed carton sealed bottom wall and a retracted position in which the reciprocating finger pulls the carton from the mandrel, the reciprocating finger movable toward the extended position by application of the vacuum to the second movable portion while communicating vacuum to the suction element, the cylinder defining an upper region and a lower region separated from one another by a base portion of the reciprocating finger, the base portion extending outwardly to contact an inner wall of the cylinder to form a seal, wherein the vacuum, communicated to the upper cylinder region, moves the finger to the extended position for contacting and engaging the carton bottom wall;

moving the first movable portion toward the mandrel;

moving the second movable portion toward the mandrel;

engaging the second movable portion with the carton bottom wall;

moving the first and second movable portions away from the mandrel, pulling the carton from the mandrel; and disengaging the second movable portion from the carton bottom wall.

* * * * *